US008974404B2

(12) United States Patent
Chen

(10) Patent No.: US 8,974,404 B2
(45) Date of Patent: Mar. 10, 2015

(54) MESSAGE DEVICE HAVING ROTARY MOTION AND TWO DIRECTIONAL LINEAR MOTION

(75) Inventor: Jui Yao Chen, Changhua County (TW)

(73) Assignee: Listore International Co., Ltd., Taichung County (TW)

( * ) Notice: Subject to any disclaimer, the term of this patent is extended or adjusted under 35 U.S.C. 154(b) by 894 days.

(21) Appl. No.: 13/193,585

(22) Filed: Jul. 28, 2011

(65) Prior Publication Data

US 2013/0030336 A1 Jan. 31, 2013

(51) Int. Cl.
*A61H 7/00* (2006.01)
*A61H 15/00* (2006.01)

(52) U.S. Cl.
CPC ..... *A61H 7/004* (2013.01); *A61H 2201/0149* (2013.01); *A61H 2201/1215* (2013.01); *A61H 2201/1669* (2013.01); *A61H 2201/1671* (2013.01); *A61H 2201/149* (2013.01)
USPC ..... 601/116; 601/89; 601/93; 601/94; 601/97; 601/101; 601/103; 601/112

(58) Field of Classification Search
CPC ..... A61H 7/004; A61H 2201/149; A61H 2201/1215; A61H 2201/1669; A61H 2201/1671; A61H 2201/0149
USPC ..... 601/49, 84–87, 89–90, 93–94, 97–98, 601/101, 103, 107–108, 112, 115, 116, 134, 601/136
See application file for complete search history.

(56) References Cited

U.S. PATENT DOCUMENTS

| | | | | |
|---|---|---|---|---|
| 6,840,914 | B1 * | 1/2005 | Takamura | 601/99 |
| 6,979,302 | B2 * | 12/2005 | Chen | 601/87 |
| 8,083,697 | B2 * | 12/2011 | Wu et al. | 601/98 |
| 8,182,436 | B2 * | 5/2012 | Zhong | 601/98 |
| 8,202,235 | B2 * | 6/2012 | Huang | 601/103 |
| 8,414,510 | B2 * | 4/2013 | Wu et al. | 601/98 |
| 8,556,835 | B2 * | 10/2013 | Ferber et al. | 601/18 |
| 2005/0256434 | A1 * | 11/2005 | Luo | 601/86 |

* cited by examiner

*Primary Examiner* — Justine Yu
*Assistant Examiner* — Douglas Sul
(74) *Attorney, Agent, or Firm* — Alan D. Kamrath; Kamrath IP Lawfirm, P.A.

(57) ABSTRACT

A massage device includes an outer housing, an inner housing, a drive motor, a gear assembly, a one-way bearing, a drive gear wheel, at least one massage member, and a linear motion device. The massage member can perform a massage through rotary motion and linear motion, and can massage by repeatedly moving forwards and backwards with respect to the user or at fixed positions. Furthermore, the gear wheels of the gear assembly are vertically disposed in the inner housing, while the drive motor is arranged in an oblique manner. Therefore, the inner housing doesn't need a large space to accommodate the gear assembly, and, consequently, the outer housing is also reduced in width.

7 Claims, 8 Drawing Sheets

MESSAGE DEVICE HAVING ROTARY MOTION AND TWO DIRECTIONAL LINEAR MOTION

BACKGROUND OF THE INVENTION

1. Field of the Invention

The present invention relates to a massage device and, more particularly, to a physical therapy type massage device.

2. Description of the Prior Art

Today, people are living under great pressure and therefore need to release stress by using some massage devices, such as massage chairs, massage waist belts or back belts. A conventional massage device 10 is shown in FIG. 1 and essentially comprises a base 11 on which is disposed a motor 12 with a drive shaft 121 engaging with two rotary gear wheels 13 at both sides thereof. The rotary gear wheels 13 are abutted against the base 11 to rotate massage heads (not shown) engaged on the rotary gear wheels 13, so that the massage heads can be rotated by the rotary gear wheels 13 to provide a massage effect.

One of the two rotary gear wheels 13 is engaged with a bevel wheel 14 which is sleeved on a shaft 15, and the bevel wheel 14 can be rotated by the rotary gear wheel 13 to move along the shaft 15, so that the massage heads (not shown) on the massage device 10 can be moved in a rotation or linear motion manner. The disadvantage of this massage device 10 is that the two rotary gear wheels 13 are vertical to the bevel wheel 14, which causes the size of the whole structure of the massage device 10 to be very big, and the applicability of the massage device 10 is limited.

On top of that, this conventional massage device is too simple in structure to provide various massage functions to meet various demands of different users.

The present invention has arisen to mitigate and/or obviate the afore-described disadvantages.

SUMMARY OF THE INVENTION

The primary object of the present invention is to provide a compact massage device capable of performing a massage through rotary and linear motions.

To achieve the above object, a massage device in accordance with the present invention comprises: an outer housing, an inner housing, a drive motor, a gear assembly, an one-way bearing, a drive gear wheel, at least one massage member, and a linear motion device.

The outer housing includes an assembling space and an arc-shaped groove formed at one side thereof.

The inner housing is formed with a receiving space and received in the assembling space of the outer housing.

The drive motor includes a drive shaft with a toothed portion and is obliquely arranged with respect to the inner housing, and the toothed portion of the drive shaft is inserted in the receiving space of the inner housing.

The gear assembly includes a first gear wheel, a second gear wheel, and a third gear wheel which are disposed in the receiving space of the inner housing. The first gear wheel is engaged with the toothed portion of the drive shaft of the drive motor and drivingly connected to the second gear wheel, the third gear wheel is engaged with the second gear wheel, and a third rotary shaft is inserted in the third gear wheel.

The one-way bearing is mounted at one end of the third rotary shaft.

The drive gear wheel is sleeved on the one-way bearing and drivingly connected to the third rotary shaft.

The at least one massage member has one end inserted in the inner housing and engaged with another end of the third rotary shaft, and has another end formed with a massage portion which extends out of the outer housing.

The linear motion device comprises a screw and a linkage device rotatably mounted on the screw and engaged with the drive gear wheel. The screw is disposed in the receiving space of the inner housing, and both ends of the screw extend out of the inner housing. The linkage device is provided with a drive portion to be inserted in a threaded portion formed on an outer surface of the screw.

The massage members is capable of performing a massage through rotary motion and linear motion, and can massage by repeatedly moving forwards and backwards with respect to the user or at fixed positions. Furthermore, the gear wheels of the gear assembly are vertically disposed in the inner housing, while the drive motor is arranged in an oblique manner. Therefore, the inner housing doesn't need a large space to accommodate the gear assembly, and, consequently, the outer housing is also reduced in width.

DETAILED DESCRIPTION OF THE PREFERRED EMBODIMENTS

Figure 1:
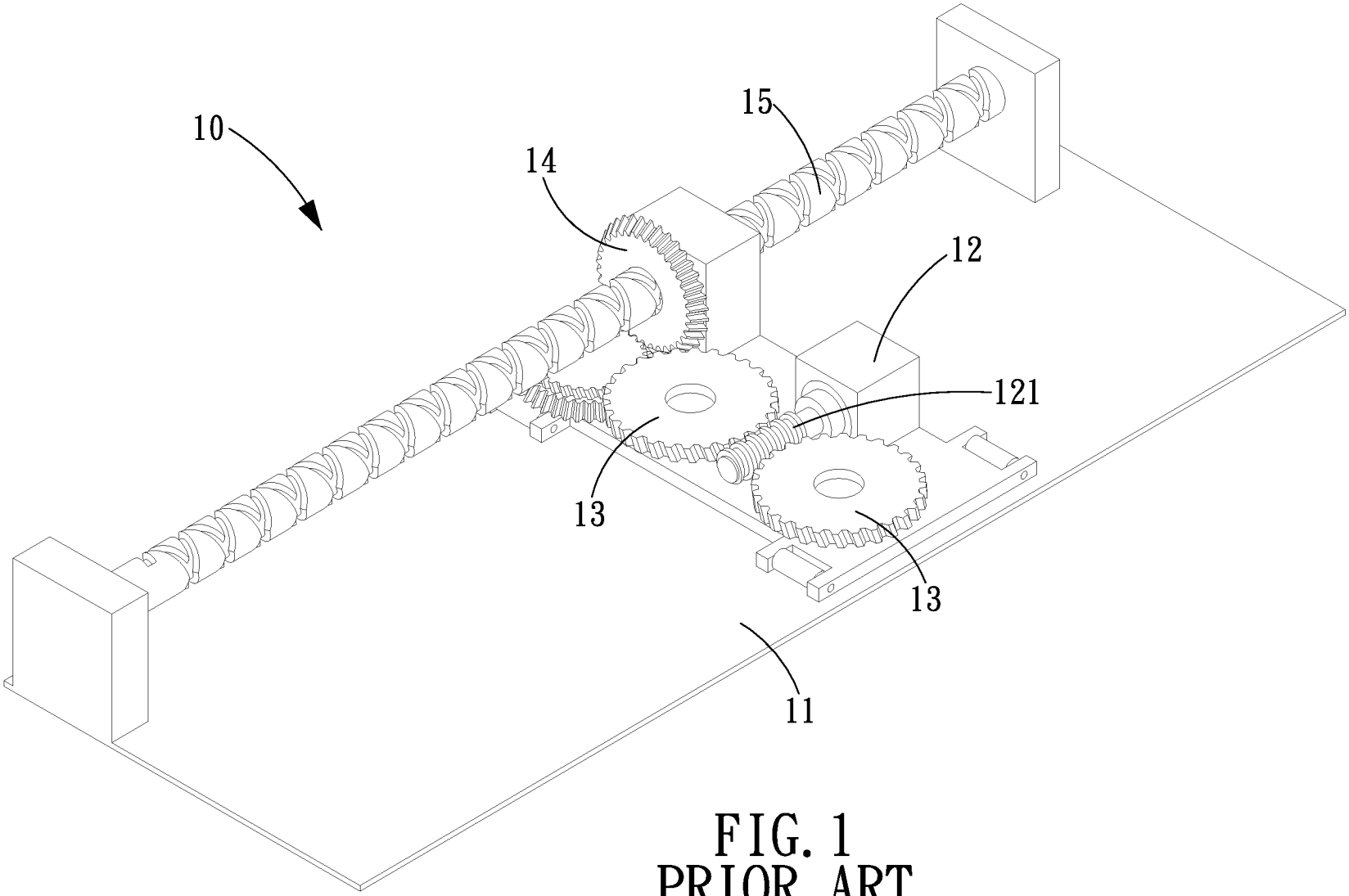
FIG. 1 PRIOR ART
FIG. 1 shows a conventional massage device.
Figure 2:
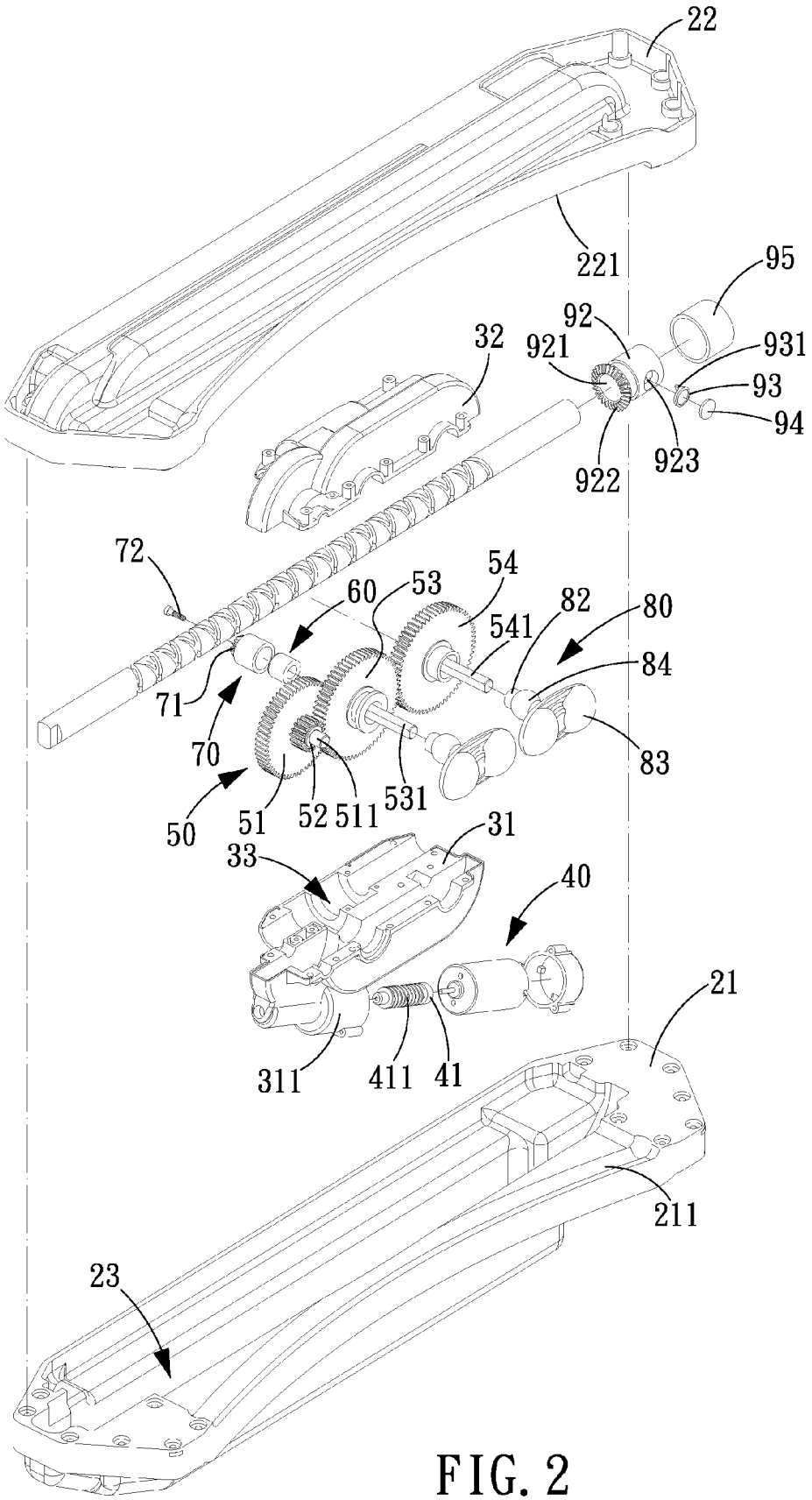
FIG. 2 is an exploded view of a massage device in accordance with the present invention.
Figure 3:
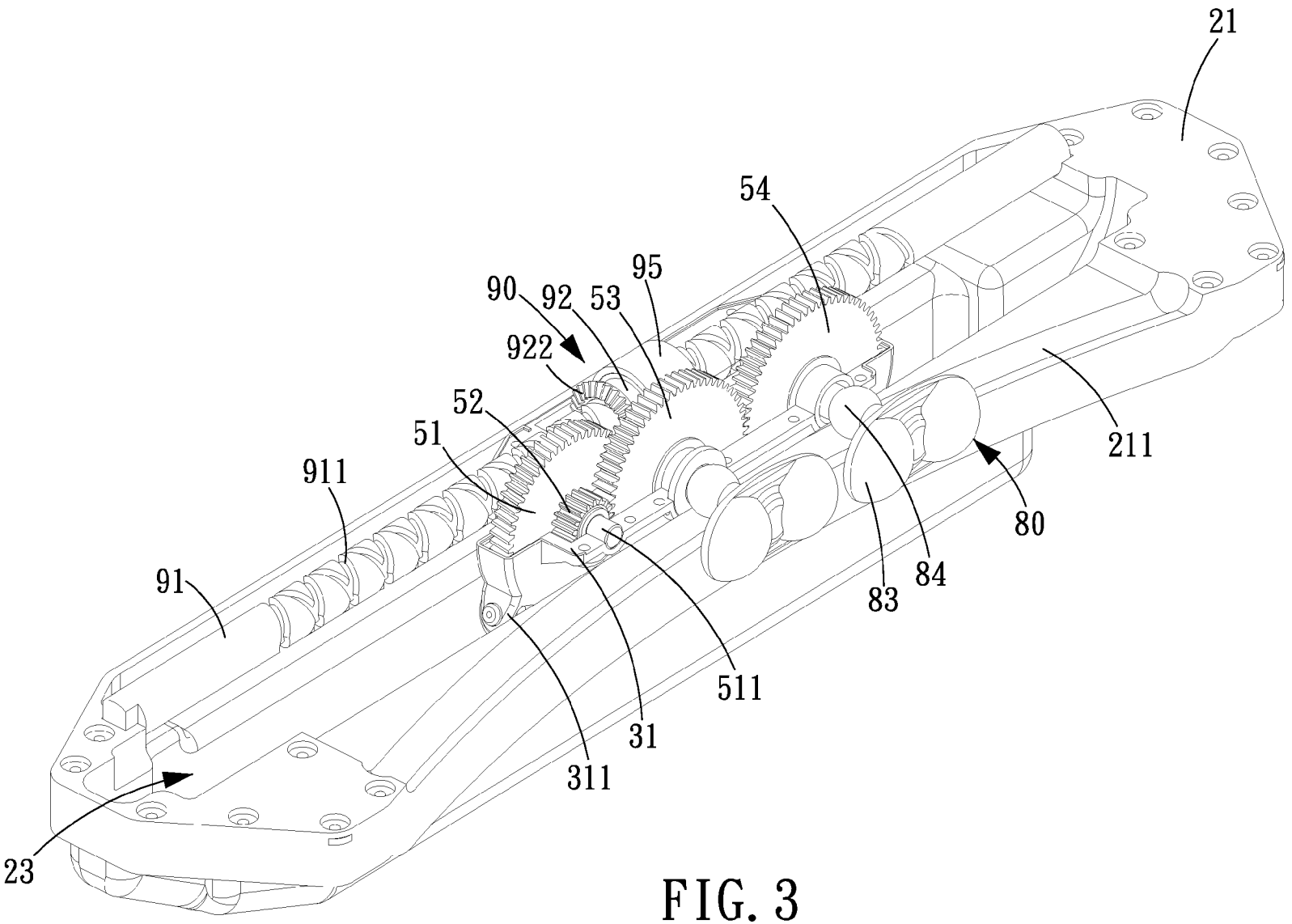
FIG. 3 is an assembly view of a part of the massage device in accordance with the present invention.
Figure 4:
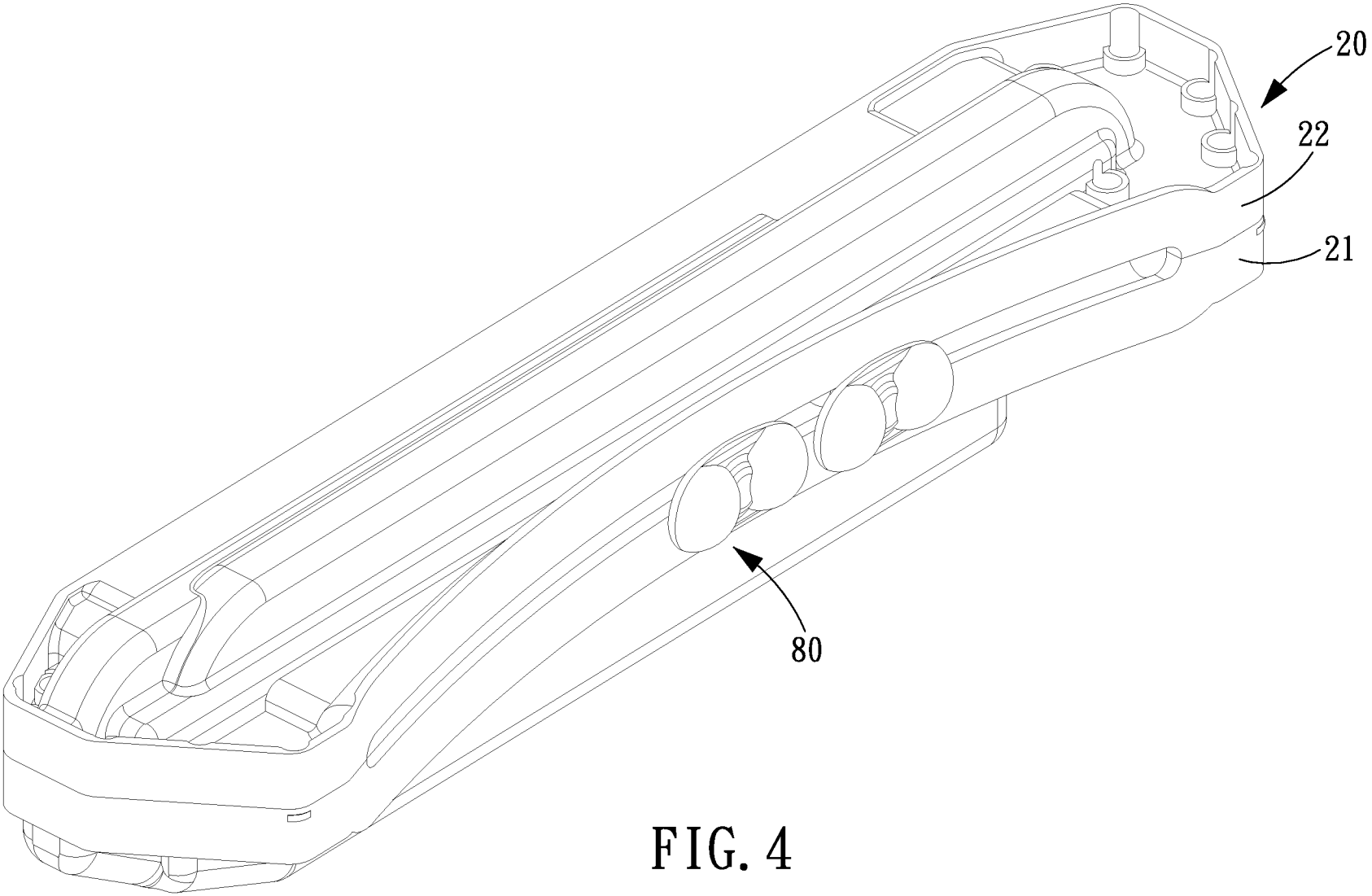
FIG. 4 is an assembly view of the massage device in accordance with the present invention.

The present invention will be clearer from the following description when viewed together with the accompanying drawings, which show, for purpose of illustration only, the preferred embodiments in accordance with the present invention.

Referring to FIGS. 2-7, a massage device in accordance with a preferred embodiment of the present invention comprises: an outer housing 20, an inner housing 30, a drive motor 40, a gear assembly 50, an one-way bearing 60, a drive gear wheel 70, a plurality of massage members 80, and a linear motion device 90.

The outer housing 20 includes a lower outer part 21 and an upper outer part 22 which are jointed together to form an assembling space 23. At one side of each of the upper and lower outer parts 22, 21 is formed an arc-shaped groove 221, 211, and both ends of the arc-shaped grooves 211, 221 are located farther from the assembling space 23 than the middle portions of the arc-shaped grooves 211 and 221.

The inner housing 30 includes a lower inner part 31 and an upper inner part 32 which are jointed to each other to form a receiving space 33. The lower inner part 31 is formed with an oblique mounting portion 311 in communication with the receiving space 33, and the inner housing 30 is received in the assembling space 23 of the outer housing 20.

The drive motor 40 is received in the oblique mounting portion 311 of the inner housing 30 and has a drive shaft 41 with a toothed portion 411. The drive motor 40 is oblique with respect to the inner housing 30, and the toothed portion 411 of the drive shaft 41 is inserted in the receiving space 33 of the inner housing 30.

The gear assembly 50 is disposed in the receiving space 33 of the inner housing 30 and comprises a first gear wheel 51, a second gear wheel 52, a third gear wheel 53 and a fourth gear wheel 54. The first gear wheel 51 is engaged with the toothed portion 411 of the drive shaft 41 of the drive motor 40 and is coaxially connected to the second gear wheel 52 by a connecting shaft 511. The third gear wheel 53 is engaged with the second gear wheel 52, and the fourth gear wheel 54 is engaged with the third gear wheel 53. A third rotary shaft 531 is inserted in the third gear wheel 53, and a fourth rotary shaft 541 is inserted in the fourth gear wheel 54.

The one-way bearing 60 is mounted at one end of the third rotary shaft 531.

The drive gear wheel 70 includes a bevel toothed drive portion 71 and is sleeved on the one-way bearing 60. The one-way bearing 60 is located between the drive gear wheel 70 and the third rotary shaft 531. A fastener 72 is inserted through the drive gear wheel 70 and the third rotary shaft 531. The drive gear wheel 70 and the third rotary shaft 531 are drivingly connected and are able to rotate in a one-way manner with respect to the one-way bearing 60.

Each massage member 80 is formed with a connecting hole 81 and a connecting end 82 at one end thereof and a massage portion 83 at another end thereof. Between the connecting end 82 and the massage portion 83 is a guiding portion 84 which is a round structure in this embodiment. The respective massage members 80 have the connecting ends 82 inserted in the inner housing 30. Another end of the third rotary shaft 531 and the fourth rotary shaft 541 are engaged in the connecting holes 81, making the massage members 80 drivingly connected to the third rotary shaft 531 and the fourth rotary shaft 541. The guiding portions 84 of the massage members 80 are, received in the arc-shaped grooves 211 of the outer housing 20, and the massage portions 83 are extended out of the outer housing 20.

The linear motion device 90 comprises a screw 91 and a linkage device rotatably mounted on the screw 91.

The screw 91 is formed in its outer surface with a threaded portion 911 which takes the form of a double lead thread in this embodiment. The screw 91 is disposed in the receiving space 33 of the inner housing 30. Both ends of the screw 91 extend out of the inner housing 30 and are fixed in the assembling space 23 of the outer housing 20. An extending direction of the screw 91 is defined as an axial direction, and the connecting shaft 511, the third rotary shaft 531 and the fourth rotary shaft 541 of the gear assembly 50 extend in a radial direction which is vertical to the axial direction.

The linkage device comprises a linkage gear wheel 92, a drive member 93, a stopping member 94 and a sleeve 95. The linkage gear wheel 92 is formed with a through hole 921 for insertion of the screw 91. At one end of the linkage gear wheel 92 is formed a bevel toothed portion 922 for engaging with the bevel toothed drive portion 71 of the drive gear wheel 70, and in the outer surface of the linkage gear wheel 92 is defined a penetrating hole 923. The drive member 93 is provided with a protruding drive portion 931 to be inserted in the threaded portion 911 of the screw 91 when the drive member 93 is received in the penetrating hole 923 of the linkage gear wheel 92. The stopping member 94 is then received in the penetrating hole 923 and pressed against the drive member 93. The sleeve 95 is sleeved on the linkage gear wheel 92 to prevent the drive member 93 and the stopping member 94 from disengaging from the penetrating hole 923.

When the drive motor 40 rotates, the drive shaft 41 rotates the first and second gear wheels 51, 52, then the third and fourth gear wheels 53, 54 are rotated, and finally, the massage members 80 engaged on the third and fourth gear wheels 53, 54 are rotated to provide a massage function.

When the third rotary shaft 531 is driven to rotate by the third gear wheel 53, the drive gear wheel 70 will rotate together with the third rotary shaft 531 in one way due to the fact that the third rotary shaft 531 and the drive gear wheel 70 are connected by the fastener 72, and the one-way bearing 60 is disposed between the third rotary shaft 531 and the drive gear wheel 70. Then, the linkage gear wheel 92 is rotated by the rotation of the drive gear wheel 70, and the drive member 93 disposed in the linkage gear wheel 92 is caused to rotate with the linkage gear wheel 92. Since the drive portion 931 of the drive member 93 is received in the threaded portion 911 of the screw 91, when the drive member 93 rotates, the drive portion 931 of the drive member 93 will move along the threaded portion 911 of the screw 91. Furthermore, since the linkage gear wheel 92 is received in the inner housing 30, the inner housing 30 will also be moved by the drive member 93. Namely, the inner housing 30 is linearly movable with respect to the screw 91. Meanwhile, the massage members 80 engaged with the third rotary shaft 531 and the fourth rotary shaft 541 can move along with the inner housing 30 to provide a massage function by linear motion and rotary motion.

Figure 5A:
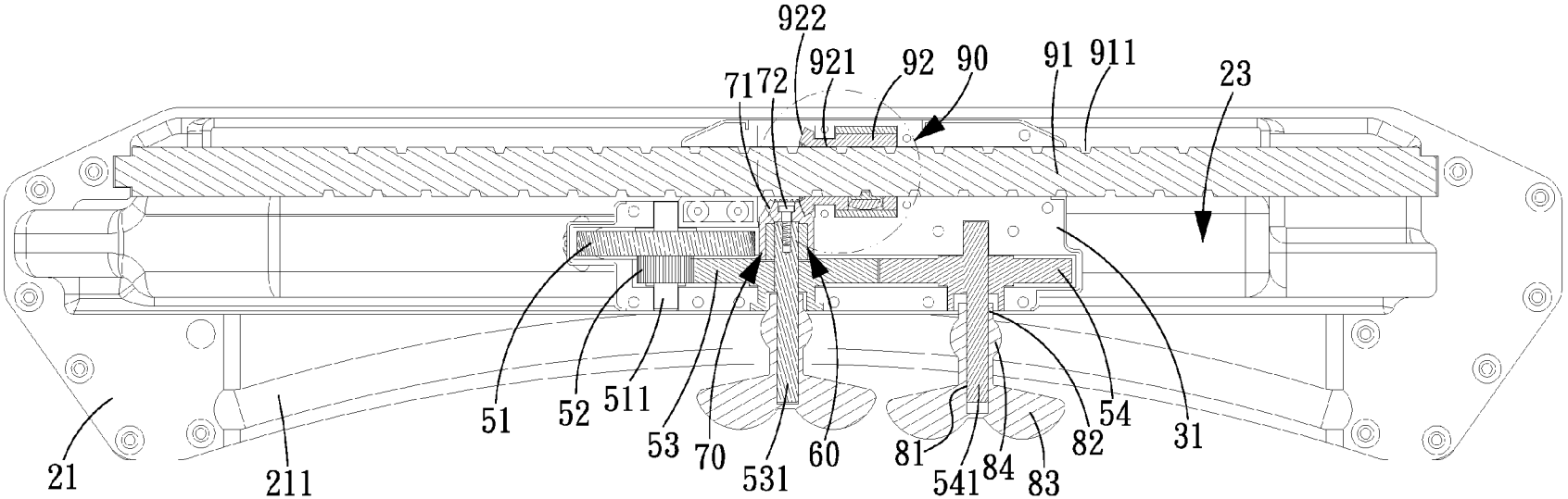
FIG. 5A is a cross sectional view of assembly view of a part of the massage device in accordance with the present invention.
Figure 5B:
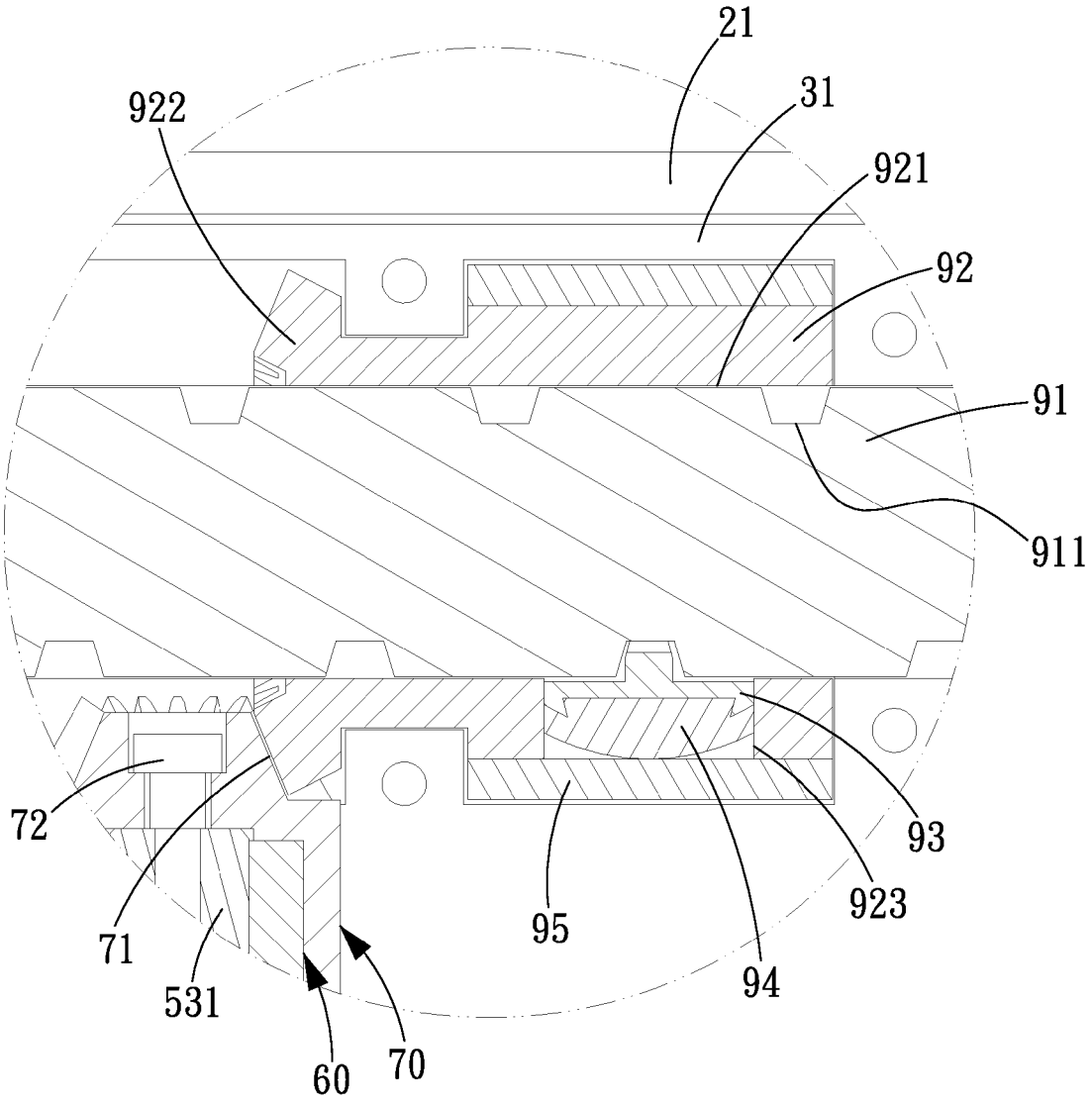
FIG. 5B is an enlarged cross sectional view of a part of FIG. 5A.
Figure 6:
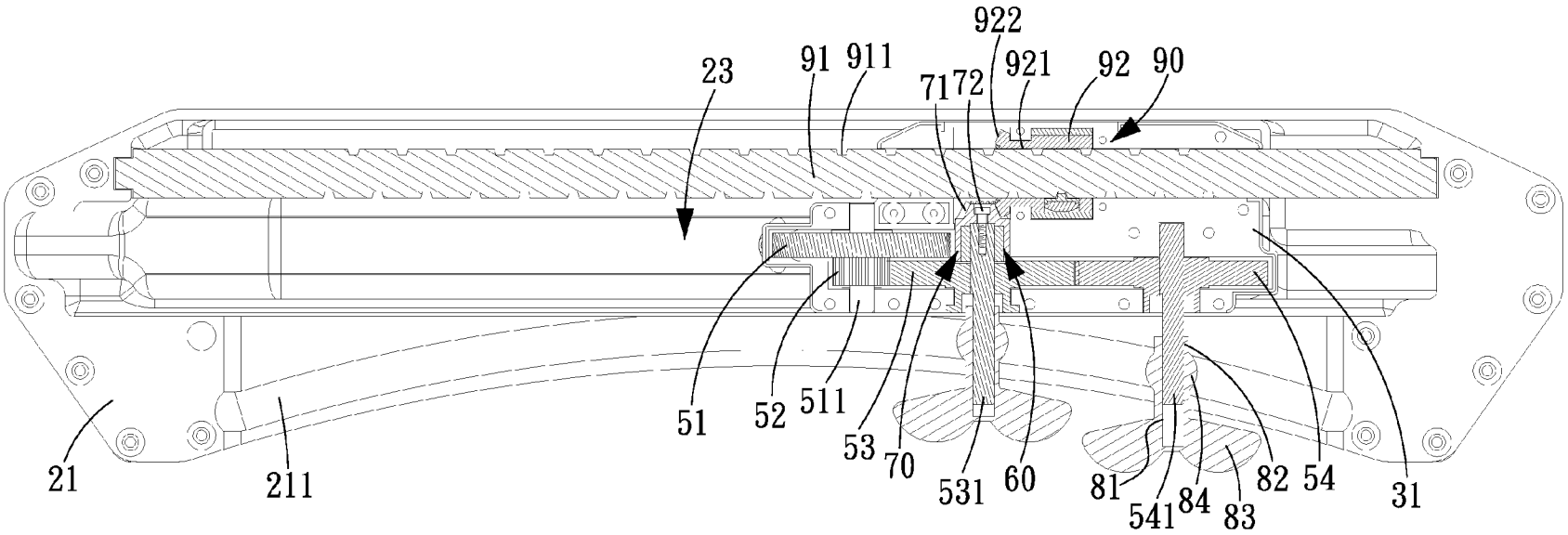
FIG. 6 is an operational view of the massage device in accordance with the present invention.
Figure 7:
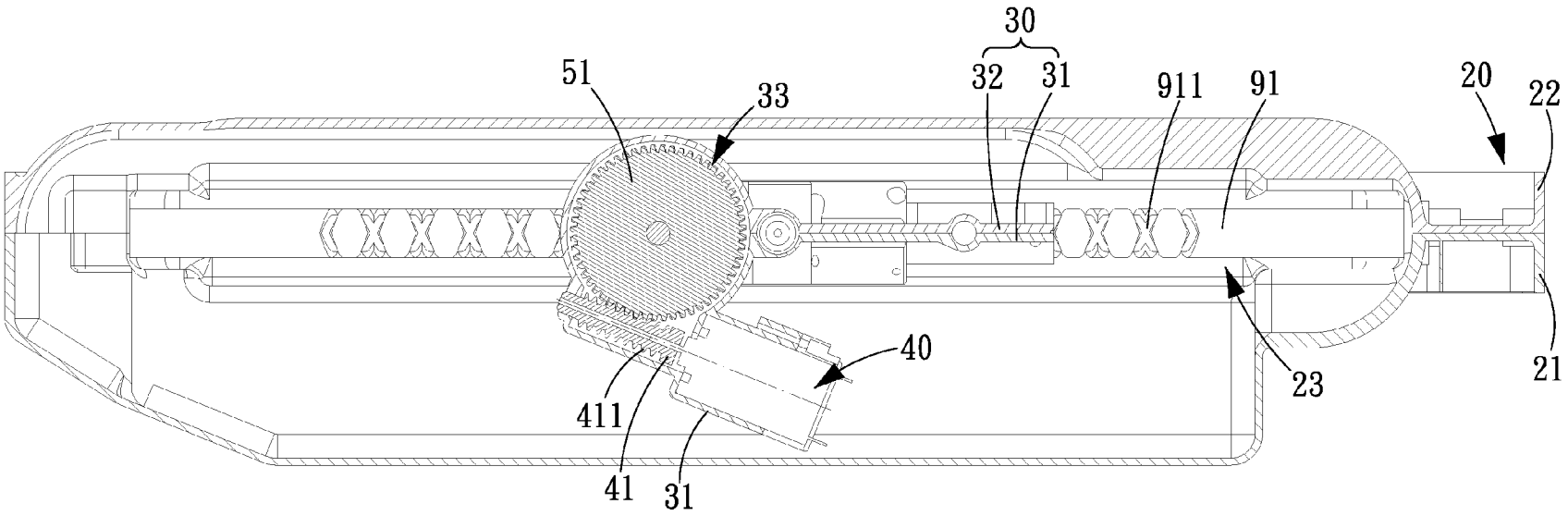
FIG. 7 is another cross sectional view of the massage device in accordance with the present invention.

When the inner housing 30 moves linearly along the screw 91, the guiding portions 84 of the respective massage members 80 are moving in the arc-shaped grooves 211, 221 of the outer housing 20. As shown in FIG. 5A, the massage members 80 are located at a position nearest to the assembling space 23 of the outer housing 20. When the inner housing 30 goes on moving toward both ends of the arc-shaped grooves 211, 221, the massage members 80 will move away from the assembling space 23, because both ends of the arc-shaped grooves 211, 221 are located farther from the assembling space 23 than the middle portions of the arc-shaped grooves 211 and 221, and the guiding portions 84 of the massage members 80 are received in the arc-shaped grooves 211, 221. As shown in FIG. 9, the continuous moving of the inner housing 30 makes the massage members 80 move away from or towards the assembling space 23 repeatedly. Therefore, when the massage members 80 are used, the user can feel that the massage members 80 perform a massage by repeatedly moving forwards and backwards with respect to the user.

On the other hand, the screw 91 takes the form of a double lead thread in this embodiment, and the inner housing 30 can be driven by the drive member 93 to move back and forth along the screw 91 when the drive motor 40 only rotates in one direction. When the drive motor 40 rotates in a reversed direction, the third gear wheel 53 is unable to drive the drive gear wheel 70 to rotate, since the thread rotary shaft 531 of the third gear wheel 53 is inserted in the one-way bearing 60. Therefore, when the drive gear wheel 70 stops rotating, the inner housing 30 consequently stops moving with respect to the screw 91, and the third gear wheel 53 and the one-way bearing 60 rotate idly with respect to the drive gear wheel 70. At this moment, the massage members 80 perform a massage at fixed positions.

It is clear from the above description that the massage members 80 can perform a massage through rotary motion and linear motion, and can massage by repeatedly moving forwards and backwards with respect to the user or at fixed positions. Furthermore, the gear wheels of the gear assembly 50 are vertically disposed in the inner housing 30, while the drive motor 40 is arranged in an oblique manner Therefore, the inner housing 30 doesn't need a large space to accommodate the gear assembly 50, and, consequently, the outer housing 20 is also reduced in width.

While various embodiments in accordance with the present invention have been shown and described, it is clear to those skilled in the art that further embodiments may be made without departing from the scope of the present invention.

What is claimed is:

1. A massage device comprising:

an outer housing including an assembling space and an arc-shaped groove formed at one side thereof;

an inner housing formed with a receiving space and received in the assembling space of the outer housing;

a drive motor including a drive shaft with a toothed portion, with the drive shaft obliquely arranged with respect to the inner housing, with the toothed portion of the drive shaft inserted in the receiving space of the inner housing;

a gear assembly including a first gear wheel, a second gear wheel, and a third gear wheel disposed in the receiving space of the inner housing, with the first gear wheel engaged with the toothed portion of the drive shaft of the drive motor and drivingly connected to the second gear wheel, with the third gear wheel engaged with the second gear wheel;

a rotary shaft inserted in the third gear wheel;

a one-way bearing mounted at one end of the rotary shaft;

a drive gear wheel sleeved on the one-way bearing and drivingly connected to the rotary shaft;

first massage member having one end inserted in the inner housing, wherein the one end of the massage member has a guiding portion having an outer periphery with round cross sections parallel to the rotary shaft, with the guiding portion slideably engaged with another end of the rotary shaft, for movement parallel to the rotary shaft, with the first massage member having another end formed with a massage portion which extends out of the outer housing; and a linear motion device comprising a screw and a linkage device rotatable mounted on the screw and engaged with the drive gear wheel, with the screw disposed in the receiving space of the inner housing, wherein both ends of the screw extend out of the inner housing, with the linkage device provided with a drive portion inserted in a threaded portion formed on an outer surface of the screw, with the arc-shaped groove being arc-shaped in a plane defined by the screw and the rotary shaft, with the guiding portion received in the arc-shaped groove and moveable in a direction parallel to the screw and in a direction perpendicular to the screw.

2. The massage device as claimed in claim 1, wherein the outer housing includes a lower outer part and an upper outer part which are jointed together to form the assembling space.

3. The massage device as claimed in claim 1, wherein the inner housing includes a lower inner part and an upper inner part which are jointed to each other to form the receiving space.

4. The massage device as claimed in claim 1, wherein the inner housing includes a lower inner part and an upper inner part which are jointed to each other to form the receiving space, wherein the lower inner part is formed with an oblique mounting portion in communication with the receiving space, and wherein the drive motor is received in the oblique mounting portion.

5. The massage device as claimed in claim 1, wherein the gear assembly further comprises a fourth gear wheel engaged with the third gear wheel, and another rotary shaft inserted in the fourth gear wheel, wherein the massage device further comprises a second massage member having another guiding portion received in the arc-shaped groove and another massage portion extending out of the outer housing, with the other guiding portion being slideably engaged with the other rotary shaft for movement parallel to the other rotary shaft.

6. The massage device as claimed in claim 1, wherein the drive gear wheel and the rotary shaft are connected by a fastener.

7. The massage device as claimed in claim 1, wherein the drive gear wheel further includes a bevel toothed drive portion, wherein the linkage device comprises a linkage gear wheel, a drive member, a stopping member and a sleeve, wherein the linkage gear wheel is formed with a through hole for insertion of the screw and a penetrating hole, wherein at one end of the linkage gear wheel is formed a bevel toothed portion for engaging with the bevel toothed drive portion of the drive gear wheel, wherein a protrusion is formed on the drive member, wherein the drive member is received in the penetrating hole of the linkage gear wheel, wherein the stopping member separately formed from the drive member is then received in the penetrating hole and pressed against the drive member, and wherein the sleeve is sleeved on the linkage gear wheel to prevent the drive member and the stopping member from disengaging from the penetrating hole.

* * * * *